United States Patent [19]

Overdijk et al.

[11] Patent Number: 4,874,982

[45] Date of Patent: Oct. 17, 1989

[54] DISPLAY DEVICE WITH ADJUSTABLE DEFLECTION UNIT

[75] Inventors: Dik R. Overdijk; Antonius J. J. Bolder; Leopold C. M. Beirens; Piet C. J. Van Rens, all of Eindhoven, Netherlands

[73] Assignee: U.S. Philips Corporation, New York, N.Y.

[21] Appl. No.: 208,952

[22] Filed: Jun. 17, 1988

[30] Foreign Application Priority Data

Jun. 18, 1987 [NL] Netherlands ..... 8701421

[51] Int. Cl.[4] ..... H01J 29/70; H01F 3/00

[52] U.S. Cl. ..... 313/440; 315/248; 335/212

[58] Field of Search ..... 313/440, 459, 477 R, 313/413, 421, 437, 438, 482, 146, 152; 335/212; 358/248, 249

[56] References Cited

U.S. PATENT DOCUMENTS

| | | | |
|---|---|---|---|
| 4,130,836 | 12/1978 | Kornaker | 335/212 X |
| 4,261,017 | 4/1981 | Branton | 335/212 X |
| 4,490,645 | 12/1984 | Hamersma | 313/440 |
| 4,668,929 | 5/1987 | Bernhard | 335/212 X |

*Primary Examiner*—Kenneth Wieder

[57] ABSTRACT

Display device includes a cathode ray tube having an envelope 1 with a number of reference surfaces on the walls of V-shaped grooves provided on positioning studs 14. The deflection unit 10 is provided with adjustable camming members 15 which lie against respective reference surfaces. The position of the deflection unit 10 relative to the envelope 1 can be adjusted by rotating camming members 15.

4 Claims, 3 Drawing Sheets

DISPLAY DEVICE WITH ADJUSTABLE DEFLECTION UNIT

BACKGROUND OF THE INVENTION

The invention relates to a display device comprising a cathode-ray tube with an envelope formed by a display window, a neck and a funnel-shaped portion which connects the display window to the neck. A deflection unit is mounted on the envelope at the area of the transition from the neck to the funnel-shaped portion of the envelope by elements for connecting the deflection unit to the envelope.

The invention further relates to a cathode-ray tube and a deflection unit for use in such a display device.

U.S. Pat. No. 3,986,156 describes such a display device in which an annular platform is attached onto the envelope of the cathode-ray tube and the deflection unit is provided with a housing. Between the deflection unit and the platform there are rigid elements which interconnect the housing of the deflection unit and the platform. Once the position of the deflection unit has been adjusted the rigid elements are fixed in their position to the deflection unit and the platform, for example, by means of ultrasonic welding. The adjusting of the position of the deflection unit relative to the envelope is attained by handling the deflection unit, so that an optimum position relative to the envelope is obtained. Whilst the deflection unit is handled the rigid elements are under no load. Subsequently, the rigid elements are secured to the deflection unit and the envelope by means of an adhesive, such that the adjusted position is fixed.

When the deflection unit is released after the rigid elements have been fixed, these rigid elements are loaded suddenly, and the accurately adjusted positioning may be adversely affected. As a consequence hereof, the operation of the display device is also adversely affected.

SUMMARY OF THE INVENTION

The envelope is provided with a number of reference surfaces, and the elements secured to the deflection unit are adjustable elements. The position of the deflection unit relative to the envelope is adjustable dependent on the adjustable elements, each adjustable element lying against an associated reference surface. The invention is based on the insight that the position of the deflection unit relative to the envelope can be adjusted solely by handling the adjustable elements. Consequently, adverse effects to forces acting on the deflection unit are overcome, and the display device operates satisfactorily.

The reference surfaces may be formed by the wall of V-shaped grooves provided on the envelope. In practice it has been found that V-shaped grooves can readily be provided on the envelope, and that they form efficent reference surfaces.

The adjustable elements may be camming members having a conical camming surface, each camming member lying with its conical surface against a corresponding wall of a V-shaped groove, and each camming member being rotatable about an axis eccentric with respect to the conical camming surface. By means of the camming member the deflection unit can be accurately positioned in a readily conceivable way.

Three V-shaped grooves may be provided on the envelope, the walls of each V-shaped groove extending substantially perpendicular to each other, and the six walls of the V-shaped grooves forming six reference planes, and the deflection unit being provided with six adjustable camming members, which are arranged in pairs, side-by-side, and each conical camming surface of a camming member lying against a wall of a V-shaped groove. Thus, it has been found that the deflection unit can readily be moved in six degrees of freedom.

DETAILED DESCRIPTION OF THE PREFERRED EMBODIMENT

Figure 1:
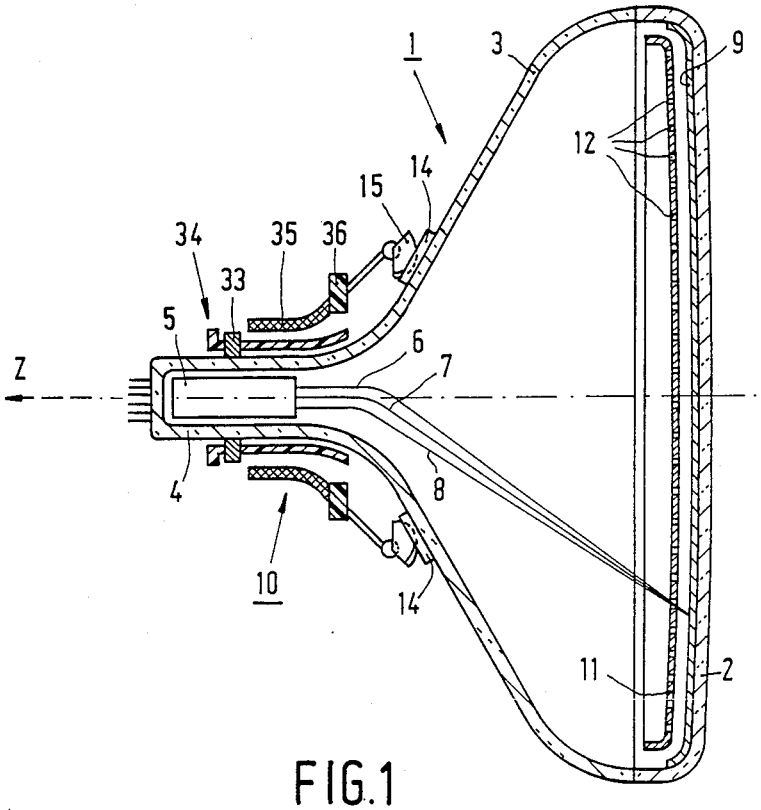
FIG. 1 is a schematic sectional view of a display device according to the invention.
Figure 3:
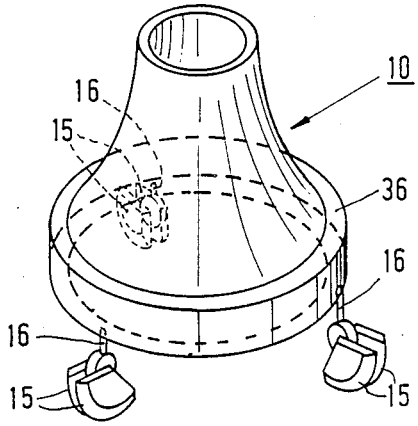
FIG. 3 is a schematic view of a deflection unit containing adjustable elements in the form of camming members, FIGS. 4*a* and *b* are schematic views of one pair of juxtaposed camming members, FIGS. 5*a* and *b* are a front view of a camming member.
Figure 2:
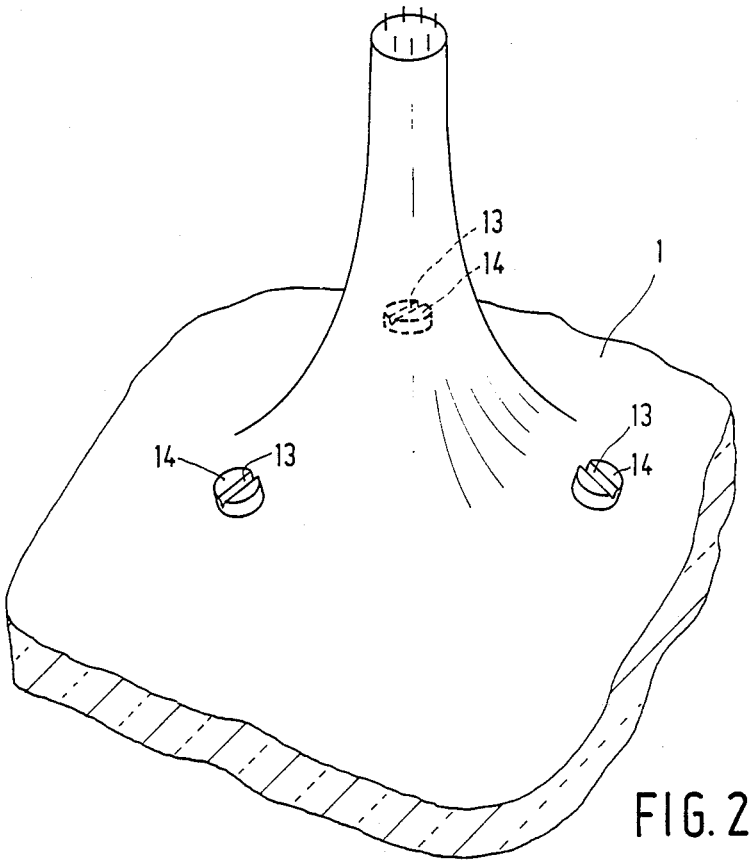
FIG. 2 is a perspective view of a part of an envelope of a cathode-ray tube having V-shaped grooves.
Figure 4A:
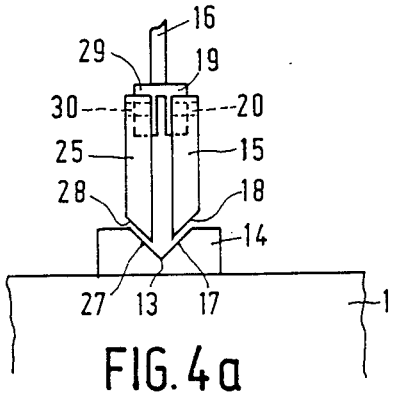
Figure 4B:
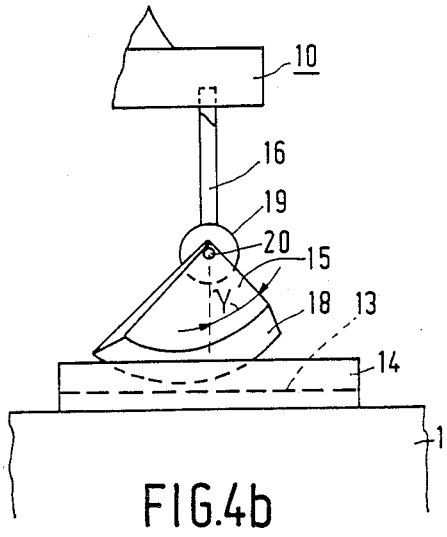
Figure 5A:
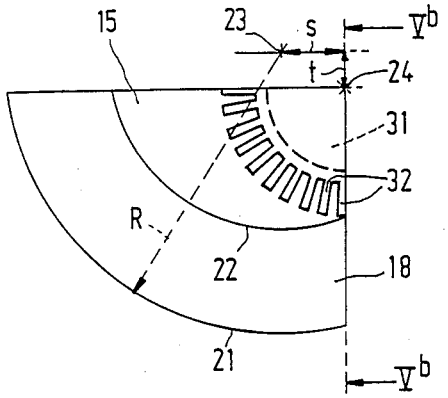
Figure 5B:
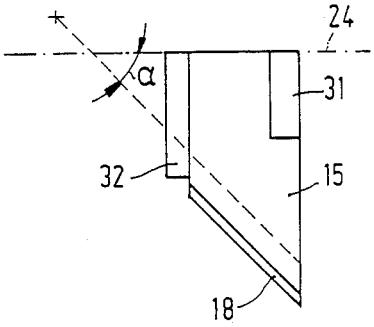

FIG. 1 is a schematic sectional view of a display device comprising a cathode-ray tube with an envelope 1 which is formed by a display window 2, a funnel-shaped portion 3 and a neck 4. The funnel-shaped portion 3 connects the display window 2 to the neck 4. In the neck 4 there is provided an electrode system 5 for generating three electron beams 6, 7 and 8. The electron beams are generated in one plane (in this case the plane of the drawing), and they are directed to a picture screen 9 which is provided on the inside of the display window 2, which picture screen consists of a great number of phosphor elements which luminesce in red, green and blue. On their way to the picture screen 9, the electron beams 6, 7 and 8 are deflected across the picture screen 9 by means of a deflection unit 10 which is mounted on the envelope 1 at the area of the transition from the neck 4 to the funnel-shaped portion 3, thereby passing through a shadow mask 11 consisting of a metal plate with apertures 12. The deflection unit 10 comprises a ferrite core 35, a synthetic resin ring 36 and a synthetic resin carrier 34 and deflection coils (not shown). The position of the deflection unit 10 relative to the envelope 1 must be adjusted so that the three electron beams 6, 7 and 8 each impinge on phosphor elements of one color only. In order to arrive at such an accurate positioning, the envelope 1 is provided with three V-shaped grooves 13 as shown in FIG. 2. These V-shaped grooves 13 may be provided, for example, in positioning studs 14 which are secured to the envelope 1, but they may also have been been provided in the envelope 1, for example, by grinding or pressing. The walls of the V-shaped grooves 13 form reference surfaces by means of which the deflection unit 10 can be positioned relative to the envelope. Six adjustable elements in the form of camming members or discs 15, 25 arranged in pairs, side-by-side are secured to the synthetic resin ring 36 of the deflection unit 10 by means of securing means 16, as shown in FIG. 3. The deflection unit 10 is placed on the envelope, such that conical edges 18, 28 of the flat discs 15, 25 lie against respective reference surfaces 17, 27 shown schematically in FIG. 4*a*. Each flat disc 15, 25 is supported by a hub 19, 29 and is provided with a shaft 20, 30 as is shown in FIGS. 4*a* and 4*b*. The hubs 19, 29 of the two adjacent flat discs 15, 25 are interconnected and they are secured to the deflection unit by means of the securing means 16. The adjacent flat discs 15, 25 can be rotated about their hubs independently of the other. The flat discs are of such a shape that the position of the deflection unit relative to the envelope changes on rotation of the discs. An example of a flat disc which has been found to provide an accurate and sufficient positioning is shown in FIGS. 5*a* and 5*b*. The flat disc 15 shown in FIG. 5*a* covers approximately one quater of a circle and is provided with a conical face 18. The peripheral edges 21 and 22 of the conical face 18 are circular having a center 23. The flat disc 15 can be rotated about an eccentric shaft 24 (corresponding to the shaft 20 or 30 in FIG. 4*a*). The flat disc 15 further contains a recess 31 in which fits the hub carrying the disc. The conical face 18 forms an angle $\alpha$ with the shaft 24 of the flat disc 15, as is shown in FIG. 5*b*.

Figure 6:
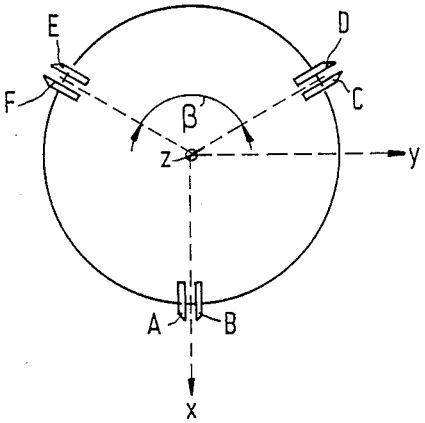
FIG. 6 is a schematic view of the position of six camming members which are arranged in pairs, side-by-side.

The adjusting of the proper position of the deflection unit is carried out by displaying a test pattern on the picture screen of the cathode-ray tube and optimising this test pattern by adjusting the position of the deflection unit by means of the adjustable flat discs. FIG. 4*b* shows that when the flat disc 15 is rotated about the eccentric shaft 20 to the distance between this shaft 20 and the envelope 1 can be adjusted, i.e. the position of the deflection unit relative to the envelope can be adjusted. The edge 18 remains lying against the wall of the V-shaped groove 13. When the envelope contains three V-shaped grooves, whose walls are substantially perpendicular to each other, and when the deflection unit is provided with six adjustable flat discs which are arranged in pairs, side-by-side, the deflection unit can readily be positioned in six degrees of freedom. The degrees of freedom are explained by means of FIG. 6. FIG. 6 schematically shows the position of six flat discs A, B, C, D, E and F viewed from the side of the electrode system in the direction of the picture screen. The flat discs which are arranged in pairs, side-by-side are at an angle $\beta=120°$ to one another. The six degrees of freedom which are adjustable are the translations in the x, y, and z-direction and the rotations about the x, y, and z-axes. Dependent upon the shape of the flat discs, the elementary coil displacements, i.e. the translations in the x, y and z-directions, denoted here as $\Delta x$, $\Delta y$ and $\Delta z$, respectively, and the rotations about the x, y and z-axes, denoted here as $\phi x$, $\phi y$ and $\phi z$, respectively, can be achieved by adjusting the angle $\gamma$ (see FIG. 4*b*).

By way of example, a flat disc having the following dimensions is used (see FIGS. 5*a* and 5*b*): R=22.91 mm, S=5.28 mm, T=3.29 mm and $\alpha=45°$. Further, the z-axis coincides with the axis of the cathode-ray tube (see FIG. 1) and z=0 when the deflection unit lies 2.50 mm away from the envelope. Table 1 lists for each flat disc the values of the angle $\gamma$ (see FIG. 4*b*) in degrees, and the elementary displacement corresponding to this position, the values of the translations being indicated in millimeters and of the rotations in degrees. The values of the angles $\gamma$ for extreme movements of the deflection unit are listed in degrees in table 2. For the translations $\Delta x$, $\Delta y$ a displacement of 0.30 mm has been adopted, for the translations $\Delta z$ a displacement of 1.25 mm has been adopted, and for the rotations a rotation through 0.50° has been adopted. In practice it has been found that this is sufficient to obtain an optimum positioning.

When the test pattern displayed by the cathode-ray tube is optimal, the position of the flat discs relative to the corresponding hub is fixed, for example by means of ultasonic welding or laser welding.

The positioning of the deflection unit can readily be mechanised by, for example, providing each flat disc with an upright toothed edge 32. In this case, the angle $\gamma$ (see FIG. 4*b*) can be adjusted by a kind of screwdriver which fits in the teeth of the upright edge of the flat disc. The screwdriver may be driven by an electromotor which is controlled by a microprocessor. In this way, each position of the flat discs can be adjusted, so as to obtain an optimum picture. By using the screwdriver as a welding electrode the position of the flat discs relative to the hubs can be fixed, for example, by means of ultrasonic welding.

The accurately positioned deflection unit is then fixed on the cathode-ray tube, for example, by using a clamping strip 33 (see FIG. 1). However, it is also possible to connect the conical face of each disc to the wall of the corresponding V-shaped groove, for example, by ultrasonic welding or laserwelding or by means of an adhesive.

It will be clear that the present invention is not limited to the embodiment described herein, but that many variations are possible to those skilled in the art without departing from the scope of the invention.

TABLE 1

| Elementary displacements of the deflection unit. |
|---|
| $\Delta x = 0.00$ $\phi_x = 0.00$ $\Delta y = 0.00$ $\phi_y = 0.00$ $\Delta z = 0.00$ $\phi_z = 0.00$ |
| $\gamma_A = 45.43$ $\gamma_B = 45.58$ $\gamma_C = 45.33$ $\gamma_D = 44.53$ $\gamma_E = 44.09$ $\gamma_F = 45.05$ |
| $\Delta x = 0.30$ $\phi_x = 0.00$ $\Delta y = 0.00$ $\phi_y = 0.00$ $\Delta z = 0.00$ $\phi_z = 0.00$ |
| $\gamma_A = 43.57$ $\gamma_B = 43.67$ $\gamma_C = 48.88$ $\gamma_D = 42.75$ $\gamma_E = 42.39$ $\gamma_F = 48.50$ |
| $\Delta x = 0.00$ $\phi_x = 0.50$ $\Delta y = 0.00$ $\phi_y = 0.00$ $\Delta z = 0.00$ $\phi_z = 0.00$ |
| $\gamma_A = 56.27$ $\gamma_B = 34.49$ $\gamma_C = 52.81$ $\gamma_D = 62.11$ $\gamma_E = 26.80$ $\gamma_F = 37.54$ |
| $\Delta x = 0.00$ $\phi_x = 0.00$ $\Delta y = 0.30$ $\phi_y = 0.00$ $\Delta z = 0.00$ $\phi_z = 00$ |
| $\gamma_A = 42.50$ $\gamma_B = 48.56$ $\gamma_C = 45.11$ $\gamma_D = 41.47$ $\gamma_E = 47.07$ $\gamma_F = 45.29$ |
| $\Delta x = 0.00$ $\phi_x = 0.00$ $\Delta y = 0.00$ $\phi_y = 0.50$ $\Delta z = 0.00$ $\phi_z = 0.00$ |
| $\gamma_A = 31.21$ $\gamma_B = 31.38$ $\gamma_C = 62.22$ $\gamma_D = 41.72$ $\gamma_E = 41.50$ $\gamma_F = 61.58$ |
| $\Delta x = 0.00$ $\phi_x = 0.00$ $\Delta y = 0.00$ $\phi_y = 0.00$ $\Delta z = 1.25$ $\phi_z = 0.00$ |
| $\gamma_A = 55.85$ $\gamma_B = 56.07$ $\gamma_C = 55.70$ $\gamma_D = 54.50$ $\gamma_E = 53.84$ $\gamma_F = 55.29$ |
| $\Delta x = 0.00$ $\phi_x = 0.00$ $\Delta y = 0.00$ $\phi_y = 0.00$ $\Delta z = 0.00$ $\phi_z = 0.50$ |
| $\gamma_A = 36.83$ $\gamma_B = 54.27$ $\gamma_C = 36.62$ $\gamma_D = 53.61$ $\gamma_E = 35.25$ $\gamma_F = 53.61$ |
| $\Delta x = -0.30$ $\phi_x = 0.50$ $\Delta y = -0.30$ $\phi_y = -0.50$ $\Delta z = 1.25$ $\phi_z = -0.50$ |
| $\gamma_A = 94.30$ $\gamma_B = 49.41$ $\gamma_C = 51.67$ $\gamma_D = 70.63$ $\gamma_E = 46.68$ $\gamma_F = 19.02$ |
| $\Delta x = 0.30$ $\phi_x = -0.50$ $\Delta y = 0.30$ $\phi_y = 0.50$ $\Delta z = -1.25$ $\phi_z = +0.50$ |
| $\gamma_A = -3.44$ $\gamma_B = 41.75$ $\gamma_C = 38.99$ $\gamma_D = 18.42$ $\gamma_E = 41.49$ $\gamma_F = 71.09$ |

What is claimed is:

1. A cathode ray tube display device comprising: an envelope formed by a display window, a neck and a funnel-shaped portion which connects the display window to the neck, a plurality of reference surfaces on said envelope; a plurality of adjustable elements engaging said reference surfaces; a deflection unit mounted on the envelope at the area of the transition from the neck to the conical part of the envelope, and attached to said adjustable elements for connecting the deflection unit to the envelope, the position of the deflection unit relative to the envelope being adjustable by adjusting the adjustable elements.

2. A display device as claimed in claim 1, characterized in that the reference surfaces are the walls of V-shaped grooves provided on the envelope.

3. A display device as claimed in claim 2, characterized in that the adjustable elements are camming members each having a conical camming surface, each camming member lying with its conical surface against a corresponding wall of a V-shaped groove, and each camming member being rotatable about an axis eccentric with respect to the concial camming surface.

4. A display device as claimed in claim 3, characterized in that three V-shaped grooves are provided on the envelope, the walls of each V-shaped groove being substantially perpendicular to each other, and the six walls of the V-shaped grooves forming six reference surfaces, and the deflection unit being provided with six adjustable camming members which are arranged in pairs, side-by-side, and each conical camming surface of a camming member lying against a wall of a V-shaped groove.

* * * * *